US007329809B2

(12) United States Patent
Marosevic

(10) Patent No.: US 7,329,809 B2
(45) Date of Patent: Feb. 12, 2008

(54) MOUTHPIECE OF A TRUMPET OR SIMILAR MUSICAL INSTRUMENT

(76) Inventor: Igor Marosevic, Gorenjska Cesta 33., 4240 Radovaljica (SI)

( * ) Notice: Subject to any disclaimer, the term of this patent is extended or adjusted under 35 U.S.C. 154(b) by 332 days.

(21) Appl. No.: 10/537,559

(22) PCT Filed: Feb. 18, 2003

(86) PCT No.: PCT/SI03/00004

§ 371 (c)(1),
(2), (4) Date: Jun. 3, 2005

(87) PCT Pub. No.: WO2004/051620

PCT Pub. Date: Jun. 17, 2004

(65) Prior Publication Data

US 2006/0117932 A1 Jun. 8, 2006

(30) Foreign Application Priority Data

Dec. 3, 2002 (SI) ..... 200200289

(51) Int. Cl.
*G10D 9/08* (2006.01)

(52) U.S. Cl. ..... 84/398

(58) Field of Classification Search ..... 84/383 A, 84/398, 385 A, 383 R, 380 R, 387 A, 387 R
See application file for complete search history.

(56) References Cited

U.S. PATENT DOCUMENTS 2,557,489 A * 6/1951 Wilder ..... 84/398
2,917,964 A * 12/1959 Cassinelli ..... 84/398

* cited by examiner

*Primary Examiner*—Kimberly Lockett
(74) *Attorney, Agent, or Firm*—Jackson Walker LLP; William B. Nash

(57) ABSTRACT

The purpose of the present invention is to conceive a mouthpiece of a trumpet or similar musical instrument, which would be on the one hand permanently placed onto the musical instrument, and should on the other hand enable alternatively playing either the instrument as such or—when desired—also practicing by means of the so-called buzzing the mouthpiece. The mouthpiece (2) is an axially symmetric tubular part having a connecting end portion (21) adapted for inserting into a connecting portion (10) of a trumpet (1) or similar instrument, as well as a widened and thickened opposite playing end portion (22). A blocking means (3) equipped with a ventilation opening (30) is foreseen on the outward circumferential surface of the said wall (25) of the mouthpiece (2).

10 Claims, 3 Drawing Sheets

MOUTHPIECE OF A TRUMPET OR SIMILAR MUSICAL INSTRUMENT

Invention relates to musical instruments, especially instruments, by which the sound is produced by means of the air flow, and particularly refers to mouthpieces. In addition, the invention also relates to accessories for playing musical instruments, as well as to requisites intended for performing lectures of playing instruments.

The purpose of the present invention is to conceive a mouthpiece of a trumpet or similar musical instrument, which would be on the one hand permanently placed onto the musical instrument, and should on the other hand enable alternatively playing either the instrument as such or—when desired—also practicing by means of the so-called buzzing the mouthpiece.

For the purposes of describing this invention, the term musical instrument includes all those instruments, by which the sound is produced by means of air flow and by which a funnel-shaped mouthpiece us used. Accordingly, such instrument is not only a trumpet, but also a bugle, cornet, trombone, tuba, a horn or any other similar brass instrument or wind instrument.

Furthermore, buzzing the mouthpiece or mouthpiece buzzing should be understood in terms of simulation of playing the instrument by blowing exclusively into a mouthpiece, which was prior to this invention possible only upon detaching a mouthpiece from the instrument.

In such basis in the further explanation exclusively two terms, namely a trumpet or instrument will be used in order to avoid permanently enumeration of musical instruments, however without any limitation with respect to the scope of the invention.

A mouthpiece of a trumpet or similar musical instrument seems to be a relatively simple axial-symmetric tubular part, which may thanks to its conical end portion be inserted into corresponding connecting part of a trumpet or similar instrument. The opposite end portion of the mouthpiece is relatively expansive, namely widened and thickened, and comprises a funnel-shaped cavity, namely the so-called cup, as well as a slightly rounded circumferential area, the so-called rim. In the interior of a such mouthpiece, in its central area, there is a conical passage, which is widened from the cup towards the instrument. Numerous variations of such mouthpieces are available in the practice within the standardized length and other dimensions related to attaching the mouthpiece to various instruments produced by various manufacturers, by which especially the overall length of the mouthpiece and the corresponding instrument must be taken into account, since only in this way a correct gripping the instrument in its regular position and also at the required distance from the users lips can be achieved.

Construction of the mouthpiece as such, namely defining certain features like the shape and dimensions of the cup, the rim or the conical passage as well, a desired thickness of the wall or similar, is of essential importance with respect to producing desired sounds by playing each instrument including playing each desired music style. These aspects are widely described in U.S. Pat. No. 5,847,500 (Hackl). Actually, musicians mostly use or at least try to use various mouthpieces in order to solve various problems like e.g. playing various music styles, minimizing vibrations of lips, avoiding damages of lips, elimination of sufficient weight of the mouthpiece and similar. Such challenges are described in various patent sources, e.g. JP 10214080 A (Oshita), JP 05127665 A (DAIDO STEEL CO LTD.), U.S. 2002/0066355 A1 (Parkos).

Repeated changing of mouthpieces by an instrument may result various other problems like wearing, corrosion or similar. In order to avoid such problems, a mouthpiece according to the mentioned U.S. Pat. No. 5,874,500 (Hackl) comprises a conical connecting means, which may be inserted into each desired instrument by the one of its end portions, and equipped with a screw on the other end portion, so that a mouthpiece, which also comprises a screw, may be attached thereto.

In addition, various requisites are described, which should offer certain assistance by teaching, especially by playing a trumpet or similar instrument. A requisite is described in U.S. Pat. No. 4,120,228, by which a mirror is foreseen, which is connected via appropriate beam with a tubular member being arranged at appropriate distance from the said mirror. Such requisite enables to each user a desired self-observation during blowing through the said tubular member, which simulates blowing into the instrument, on the basis of which appropriate training of mimics resulted by activation of lips and facial musculature can be performed.

Still another requisite is described in U.S. Pat. No. 6,316,707 B1, which is intended for teaching a brass or wind instrument and consists of a holding means adapted for fixation of the instrument, as well as of appropriate resting means, to which the head may be rest. The requisite should prevent practicing by sufficient pressing the instrument against the lips, and therefore teaching of correct pressing. In addition, a mouthpiece is described in U.S. Pat. No. 4,658,697 (Warren), which consists of a transparent material and by means of which observing both, position and vibration of lips during its use is enabled.

As evident from the said sources it is very important by music lectures, not only to ensure a correct playing of tone sequences, range and duration of voice by pushing buttons or blowing the air into the instrument, but also to take care about appropriate facial mimics, pressure against the lips, holding the instrument in a correct position and similar.

Still further is known, that lectures of playing a trumpet o similar musical instruments include both, playing the instrument and buzzing a mouthpiece. Such mouthpiece buzzing is a part of daily training, since during the buzzing either achieved results or also remaining deficiencies may be essentially better expressed than by playing the instrument as such. Despite to various advantages, such buzzing the mouthpiece has also essential disadvantages. For example, resistance by blowing the air into the mouthpiece is essentially lower than the resistance, which occurs by blowing into the instrument. In addition, by buzzing the mouthpiece is always difficult to ensure a correct pressure between the mouthpiece and the lips, and moreover also a correct position of the mouthpiece with respect to the mouth, i.e. in sense of regular angle between the longitudinal axis of the mouthpiece and the mouth. All these disadvantages are connected with serious problems, to which the user or a student is exposed.

In common, it is required, that during the daily training each lecture is buzzed to the mouthpiece, and after that played by the instrument. This means, that before performing such buzzing, the mouthpiece has to be removed from the instrument, and after the said buzzing, the mouthpiece has to be attached to the instrument again. In addition to repeated removing and attaching the mouthpiece, which may involve certain wearing of the mouthpiece, there are several other disadvantages like essential spent of time, problems with intonation, as well as the said troubles related to establishing a correct pressure between the lips and the mouthpiece together with positioning of the mouthpiece.

It was Mr. Mario Guarnieri, who played a trumpet with Los Angeles Philharmonic and has been aware of all these disadvantages, so that he tried to develop a requisite, which is known under the commercial name BERP (somewhere also B. E. R. P., which is the abbreviation of Buzz Extension and Resistance Piece), and is available to the public in various advertising materials related e.g. to products of a company Musical Enterprises, in Europe represented by Editions Blm, 2, rue de'l Industrie, CH-1630 Bulle (CH), or currently also on the global network (internet), where the address is www.berp.com. Among others, BERP is also a US-registered trademark owned by the said person or his company, respectively. When bearing in mind historical aspects of the discussed requisite, the earliest version of the requisite was adapted for inserting between the instrument and the mouthpiece, and there were two purposes of such proposal, namely to avoid repeated removing and placing the mouthpiece, and secondly to ensure a resistance during buzzing the mouthpiece, which corresponds to resistance available by playing the instrument. It was no doubt an excellent achievement, on the basis of which by buzzing the mouthpiece at the one hand appropriate resistance was achieved, and at the other hand also the attitude, which is very close to a desired attitude, which is common by playing the instrument. However, the requisite was still connected with serious disadvantages, which may result even aversion to playing the instrument. At the one hand it is obvious, that just the presence of even more constituent parts like before involves multiplying of undesired steps due to removing the parts from the instruments or placing them thereto, and herewith also the wearing and time required therefor. Nevertheless, the most critical disadvantage is essential extension of the overall length of the instrument with added BERP for approx. 3-4 cm, which also means a undesired change of distance between the rim on the mouthpiece and the buttons or any other other location intended for holding the instrument. Since during playing the instrument every musician is strictly concentrated to adequate playing the music incl. achieving appropriate attitude, mimics and satisfying other already mentioned aspects, he may easily forget, that the length of the instrument was changed. Accordingly, by bringing the instrument towards the lips, a very painful surprise may occur, when the mouthpiece strikes the lips or even the teeth. In addition, the attitude of hands by playing the instrument equipped with such requisite is no doubt still different as by playing the instrument as such, which is essentially expressed by young people or people with shorter arms.

Obviously, the manufacturer was aware of these disadvantages, and recently some further developments have been made, which result in a sophisticated product also named BERP, which was found in the said web page. Construction of the requisite remains essentially the same as before, but attaching thereof to the instrument was achieved in a different manner. A sleeve or a clamp was foreseen to this aim, through which a mouthpiece is inserted, which is equipped with appropriate means for ensuring each desired resistance, and on the other hand, by placing it to the corresponding instrument, the clamp is extended, and after that tensioned by means of appropriate bolt or screw. By eliminating several earlier problems, some additional disadvantages have been raised by this improved version. It should be namely taken into account, that a brass instrument, like e.g. a trumpet, is a very complicated tubular or hollow product consisting of a brass or similar material and having very thin walls. Accordingly, the instrument is very sensible with respect to shocks or any other damages, and even small deformations may result disabling or even destroying the instrument as such. Those skilled in the art, especially technicians, should understand, that squeezing the clamp in the area, where regularly only a slight inserting of a conical connecting part of the mouthpiece is foreseen, may no doubt result serious damages or even destroying the instrument. It is furthermore obvious, that the mouthpiece is placed into position, which does not correspond to position of mouthpiece by the instrument of such, since the longitudinal axis of the requisite does not coincide with the longitudinal axis of the mouthpiece connecting part of the instrument, but is parallel with respect to the last mentioned axis. Accordingly, when playing the instrument is performed or alternatively buzzing the mouthpiece, the musician is still exposed to undesired hits to various parts of his face, not only to lips or teeth, but maybe even to his nose, cheek or chin. In addition to risk of exposing the user and/or the instrument to the said damages, also the problems related to duration of attaching the mouthpiece or the BERP on the instrument or detaching them therefrom remain the same as before.

The present invention relates to a mouthpiece of a trumpet or similar musical instruments, which is formed as axially symmetric tubular part having a connecting end adapted for inserting into a connecting part of a trumpet or similar instrument, as well as a widened and thickened opposite playing end, where a funnel-shaped cavity i.e. a so-called cup is available, which is surrounded with a slightly rounded rim, and at the same time, the mouthpiece is equipped with a central passage in form of a throttle-like bore extending along its whole length, which is in appropriate manner conically widened in the direction from the said cup towards the connecting end, namely towards the instrument.

According to the invention, a ventilation opening is foreseen within the wall of a mouthpiece in a desired position between its connecting end and its playing end, while on the outward circumferential surface of the said wall of the mouthpiece a blocking means is foreseen, which is also equipped with a ventilation opening and may be shifted either from the position of at least partial coincidence of both ventilation openings into another position without the said coincidence, and vice-versa.

Accordingly, at least radially extending ventilation opening is available within the wall of the mouthpiece between its connecting end and the playing end, and at the same time on the outward circumferential surface of the said wall of the mouthpiece there is foreseen a blocking means, which also comprises a ventilation opening, so that in one particular position of the said blocking means the air flow is enabled from the central passage of the mouthpiece through the ventilation opening of the mouthpiece as well as through the ventilation opening of the said blocking means outwards to the environment of the mouthpiece, while in each other position of the blocking means such air flow is disabled.

Prefered embodiment of the mouthpiece according to the invention is characterized in that a seat is arranged on the wall of the mouthpiece in the area of the ventilation opening, namely a cylindrical cavity, which extends like a chord with respect to the circumference of the mouthpiece or at least approximatelly in its tangential direction, by which the said blocking means is tubular and comprises a ventilation opening, which extends in its radial direction, and is moreover provided with thickened ends as well as with a shifting lever in order to be held onto the mouthpiece by means of an elastic binding element. Still further may be preferred, when the blocking means is pressed towards the mouthpiece by means of the elastic binding element and comprises a cutoff, which serves for maintaining the said blocking means in a particular determined position. When desired, the blocking means is attached onto the mouthpiece by means of an elastic binding element, which extends around of at least the part of the blocking means and simultaneously also around of at least the part of the mouthpiece, by which the said binding element may be a O-ring, especially of rubber.

By another embodiment of the mouthpiece according to the invention, the blocking means is pressed onto the mouthpiece and comprises a ventilation opening, which is adapted for positioning into appropriate coincidence with the ventilation opening of the mouthpiece, when desired, and is available within a slider, which extends at least approximately in a tangential direction with respect to the circumference of the mouthpiece and may be shifted along the interior of the blocking means from its one end position into another end position thereof.

Now the invention will be explained in more detail on the basis of the embodiments, which are shown in the enclosed drawing, wherein FIG. 1 shows a trumpet equipped with a mouthpiece according to the invention;

Figure 1:
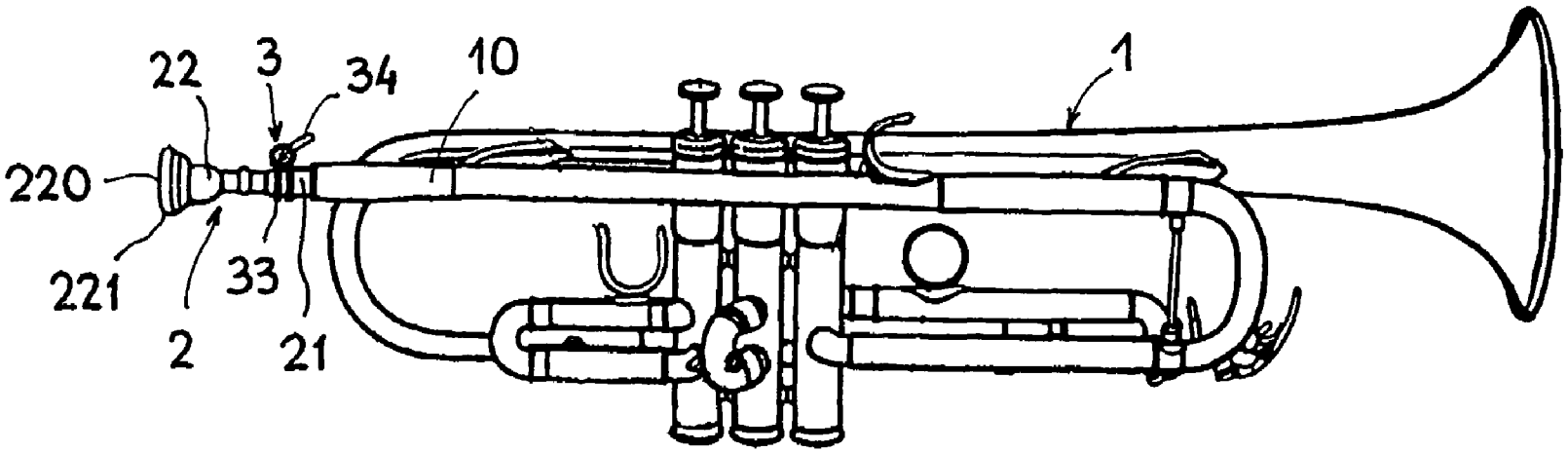

A trumpet 1 is shown in FIG. 1 as one of possible instruments, by which a mouthpiece according to the invention may be used. The trumpet 1 comprises a mouthpiece 2, which is inserted into a tubular connection portion 10 of the said trumpet 1.

The mouthpiece 2 is conceived essentially in the same manner as any other of already known and commonly used mouthpieces. This means, that the mouthpiece is an axially-symmetric tubular part having conical connecting end portion 21 adapted for inserting into the said connecting portion 10 of the trumpet 1, as well as a widened and thickened opposite playing end portion 22, where a funnel-shaped cavity i.e. a so-called cup 220 is available, which is surrounded with a slightly rounded rim 221, but at the same time, the mouthpiece 2 is equipped with a central passage 23 in form of a throttle-like bore extending along its whole length, which is in appropriate manner conically widened in the direction from the said cup 220 towards the connecting end portion 21, namely towards the instrument i.e. the trumpet 1.

According to the invention, at least approximately in radial direction extending ventilating opening 24 is foreseen within the wall 25 of the mouthpiece 2, which is arranged in a desired position somewhere between the said connecting end portion 21 and the opposite widened and thickened playing end portion 22 of the mouthpiece 2. Furthermore, a blocking means 3 is available on the outward peripheral surface of the mouthpiece 2 adjacent to the said passage 24, by which the said means is adapted for cooperation with the said passage 24, so that with help of the said blocking means 3 the central passage 23 of the mouthpiece 2 may optionally be either connected with the outside atmosphere via the said ventilation opening 24 within the wall 25 of the mouthpiece 2, or disconnected therefrom.

Position of the said opening 24 and also of the blocking means 3 is determined in such a way, that the said blocking means 3 may be easily reached by each user during playing the instrument or also immediately after playing, and moreover also in such a manner, that all above mentioned parts of the mouthpiece 2 remain at least essentially unchanged, so that the main characteristics of each mouthpiece 2 remain practically the same. A very comfortable position for arranging a ventilation opening 24 and placing the blocking means 3 is ordinary available closely to an area of the connecting end portion 21, which lies outside of the trumpet 1 or a similar musical instrument, which is also shown in the drawing.

Figure 5:
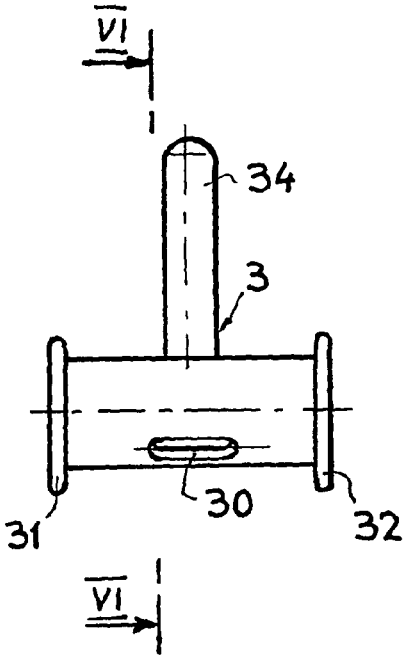
FIG. 5 is a side view of a blocking means as shown in FIGS. 1 to 4.
Figure 6:
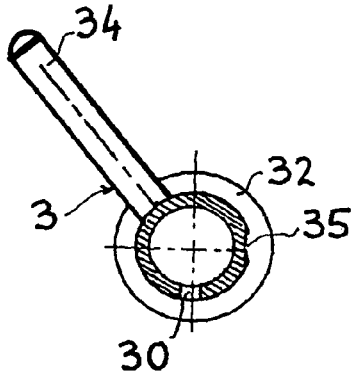
FIG. 6 is a cross-section of the blocking means along the plane VI-VI.

Preferred embodiment in accordance with FIGS. 1 to 4 includes a blocking means 3, which is separately shown in FIGS. 5 and 6 and is attached to the mouthpiece 2 by means of a seat 26, which is in this case simply manufactured in form of a cylindrical cavity and extends like a chord with respect to the circumference i.e. at least essentially in a tangential direction. As evident in the FIG. 4, the ventilation opening 24 is also foreseen in the area of the said seat 26 within the wall 24 of the mouthpiece 2. In this case, a tubular blocking means 3 comprises a ventilation opening 30, which extends at least essentially in the radial direction thereof. An extremely simple attachment to the mouthpiece 2 is enabled due to the fact, that the blocking means 3 has thickened ends 31, 32, so that an elastic binding element 33, e.g. a thoroidal element like a O-ring, may be placed around the blocking means 3 and at the same time also around the mouthpiece 2. In order to simplify positioning the blocking means 3, a handle 34 may be foreseen thereon. Furthermore, arresting of the said handle 34 together with the blocking means 3 in each desired position, as required either by playing the instrument or also by buzzing the mouthpiece 2, is ensured by means of appropriate cutoff 35.

According to the invention, each desired mouthpiece 2 together with appropriate blocking element 3 arranged thereon, is permanently attached to the belonging trumpet 1 or any other similar musical instrument, which means both, during playing the instrument and also during buzzing the mouthpiece 2.

Figure 2:
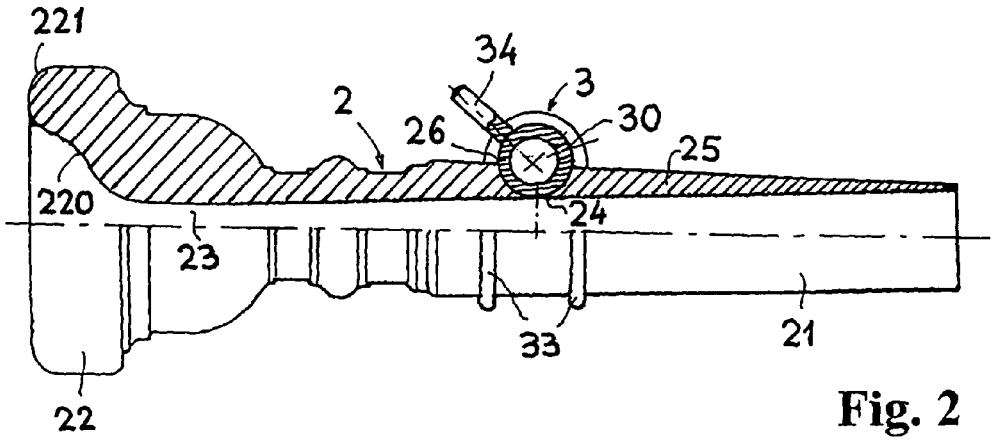
FIG. 2 is a longitudinal cross-section of a mouthpiece, shown in its state intended for playing the instrument.

When playing the instrument, the blocking means 3 is shifted into position, which is shown in FIG. 2. In such state, the ventilation opening 24 of the mouthpiece 2 is closed by means of the blocking element 3, since its ventilation opening 30 is shifted away from the ventilation opening 24 of the mouthpiece 2, so that the said ventilation openings 24, 30 do not coincide. When manufacturing of the mouthpiece 2, especially of the ventilation opening 24 thereof and its seat 26 is performed carefully, the shape of the internal passage 23 of the mouthpiece 2 remains practically the same as by any other mouthpiece, so that despite to presence of the ventilation opening 30 and the blocking means 3 also the capability of producing various tones by means of the mouthpiece 2 remains practically the same, without any undesired influence with respect to quality of the voice. The blocking means 3 is positioned in the seat 26 by means of its cutoff 35, and pressed against the mouthpiece 2 by means of the elastic binding element 33, so that any undesired shifting thereof shifting the handle 34 is quite impossible.

Figure 3:
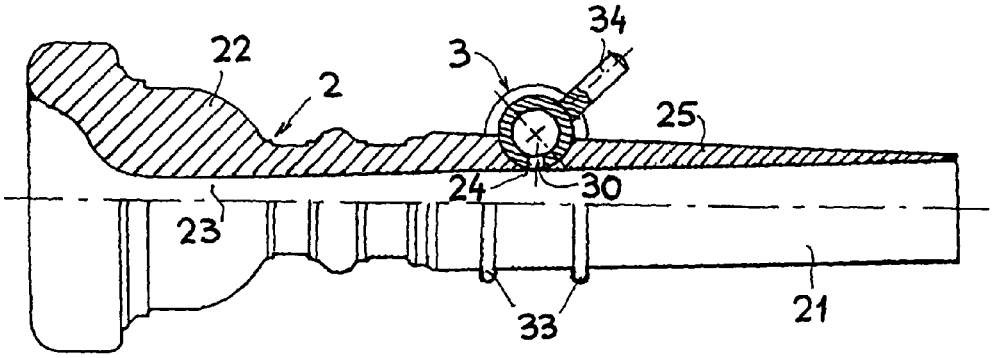
FIG. 3 is a longitudinal cross-section of a mouthpiece, shown in its state intended for buzzing the mouthpiece.
Figure 4:
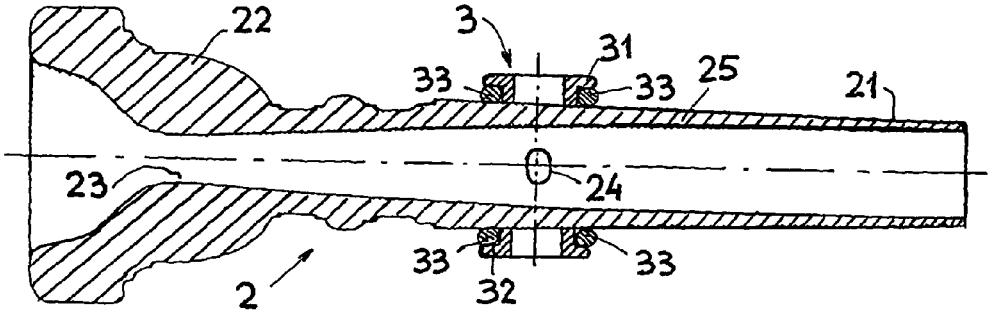
FIG. 4 is a longitudinal cross-section in a diametral plane.

After playing the trumpet 1 or similar musical instrument has ben finished, buzzing the mouthpiece 2 may be started in a very short time and without any need on removing the mouthpiece 2, by which only the handle 34 of the blocking means 3 needs to be shifted into another position as shown in FIGS. 1 and 3. In such state of the blocking means 3, position of the ventilation opening 30 of the blocking means 3 coincides with a position of the ventilation opening 24 of the mouthpiece 2. The air flow as a result of the users blowing into the mouthpiece 2, cannot reach the instrument, since it flows through the opening 24 of the mouthpiece 2 and the opening 30 of the blocking means 3 outwards to the environment. When the dimensions of both openings 24, 30 are determined in appropriate manner, there is also possible to establish a desired resistance, to which the user is normaly exposed by blowing the air into the instrument. After conclusion such buzzing, a simple shifting the handle 34 in another position enables playing the instrument again.

Figure 7:
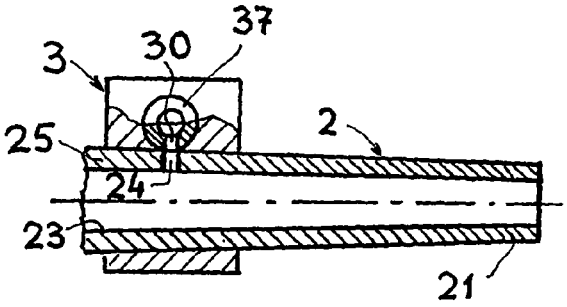
FIG. 7 shows another embodiment of the mouthpiece, namely a longitudinal cross-section thereof in the vertically arranged diametral plane.
Figure 8:
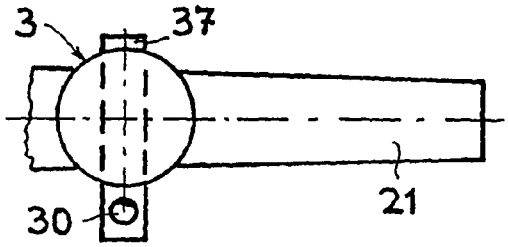
FIG. 8 is a top view of the mouthpiece in the state intended for playing the instrument.
Figure 9:
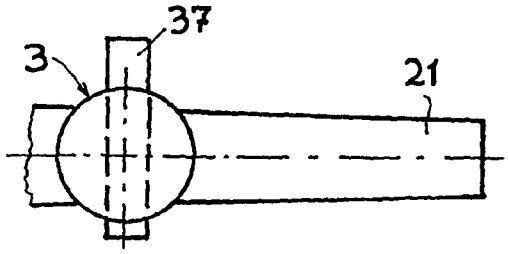
FIG. 9 is a top view of the mouthpiece as shown in FIGS. 7 and 8, in the state intended for practicing by means of buzzing the mouthpiece.

A further embodiment of the blocking means 3 is shown in FIGS. 7-9; it may also be attached, especially pressed onto a desired mouthpiece 2 having a ventilation opening 24, which extends radially through its wall 25 and is arranged in appropriate position, e.g. adjacent to the connecting end 21 of the mouthpiece 2. The blocking means 3 is also equipped with an opening 30, which extends longitudinally through a slider 37, which is arranged tangentially with respect to a mouthpiece 2 and may be shifted from its one end position (FIG. 8) to another (FIG. 9). Analogously, the blocking means 3 enables either practicing by means of the mouthpiece 2 without blowing air into the instrument by at least partial coincidence of the ventilation opening 30 of the blocking means 3 and the ventilation opening 24 of the mouthpiece 2, or also playing the instrument, when the coincidence of the said openings 24, 30 does not exist.

The invention claimed is:

1. A mouthpiece of a trumpet or similar musical instruments, comprising:

an axially symmetric tubular part;

a connecting end portion adapted for insertion into a connecting portion (10) of a trumpet or similar instrument;

an opposite playing end portion having a cup with a funnel-shaped cavity, said cup being surrounded with a slightly rounded rim;

a central passage with a throttle-like bore extending along a whole length of the mouthpiece, said passage being conically widened in a direction from the said cup towards the connecting end portion; and a ventilation opening in a wall of the mouthpiece at a desired position between the connecting end portion and the playing end portion, wherein on an outward circumferential surface of said wall of the mouthpiece a blocking element is disposed, said blocking element being adapted to allow for ventilation changes within the mouthpiece.

2. The mouthpiece according to claim 1, wherein said blocking element is in movable communication with said ventilation opening so that in one particular position of movement of said blocking element the air flow from the central passage of the mouthpiece through the ventilation opening of the mouthpiece as well as through the ventilation opening of the said blocking element is enabled, while in each other position of the blocking element such air flow is disabled.

3. The mouthpiece according to claim 1, wherein a seat is arranged on the wall of the mouthpiece in the area of the ventilation opening, said seat being formed as either a cylinder or semi-cylinder around a circumference of the mouthpiece and wherein said blocking element is tubular shaped.

4. The mouthpiece according to claims 1, wherein the blocking element has thickened end portions and a shifting lever.

5. The mouthpiece according to claim 1, wherein the blocking element is attached to the mouthpiece via an elastic binding element.

6. The mouthpiece according to claim 5, wherein the blocking element is pressed towards the mouthpiece via the elastic binding element and said blocking element comprises a cutoff, that maintains the blocking element in a particular position.

7. The mouthpiece according to claim 1, characterized in that the blocking element is attached to the mouthpiece by means of an elastic binding element that extends around of at least the part of the blocking element and at least the part of the mouthpiece.

8. The mouthpiece according to claim 7, wherein the binding element is a O-ring.

9. The mouthpiece according to claim 7, wherein the binding element is a O-ring made of rubber.

10. The mouthpiece according to claim 1, wherein the blocking element comprises a ventilation opening capable of being positioned at the ventilation opening of the mouthpiece, said blocking element also having a slider that allows user to adjust a position of said blocking element with respect to said ventilation opening.

* * * * *